United States Patent [19]

Yoshimura et al.

[11] 4,070,829

[45] Jan. 31, 1978

[54] APPARATUS FOR CONTROLLING SECONDARY AIR FOR CLEANING EXHAUST GASES

[75] Inventors: Toshimitsu Yoshimura, Shiki; Minoru Matsuda, Chofu, both of Japan

[73] Assignee: Honda Giken Kogyo Kabushiki Kaisha, Tokyo, Japan

[21] Appl. No.: 713,826

[22] Filed: Aug. 12, 1976

[30] Foreign Application Priority Data

Aug. 13, 1975 Japan ..... 50-98420
Aug. 14, 1975 Japan ..... 50-99009

[51] Int. Cl.[2] ..... F01N 3/10; F02B 75/10

[52] U.S. Cl. ..... 60/290; 60/294; 137/597; 417/278

[58] Field of Search ..... 60/290, 294, 289; 417/278; 137/597, 625.21

[56] References Cited

U.S. PATENT DOCUMENTS

| | | | |
|---|---|---|---|
| 2,347,936 | 5/1944 | Crewson | 137/597 |
| 3,147,588 | 9/1964 | Tauschek | 60/294 |
| 3,940,928 | 3/1976 | Pozniak | 60/290 |

*Primary Examiner*—Douglas Hart
*Attorney, Agent, or Firm*—Irving M. Weiner; Pamela S. Austin

[57] ABSTRACT

An apparatus cleans the exhaust gases of a motorcycle by feeding secondary air to the exhaust path of the engine. The amount of secondary air fed is controlled in proportion to the speed of the motorcycle. The apparatus includes a control valve which is operated to be opened and closed in response to the opening and closing of the throttle valve of a carburetor of the engine.

11 Claims, 9 Drawing Figures

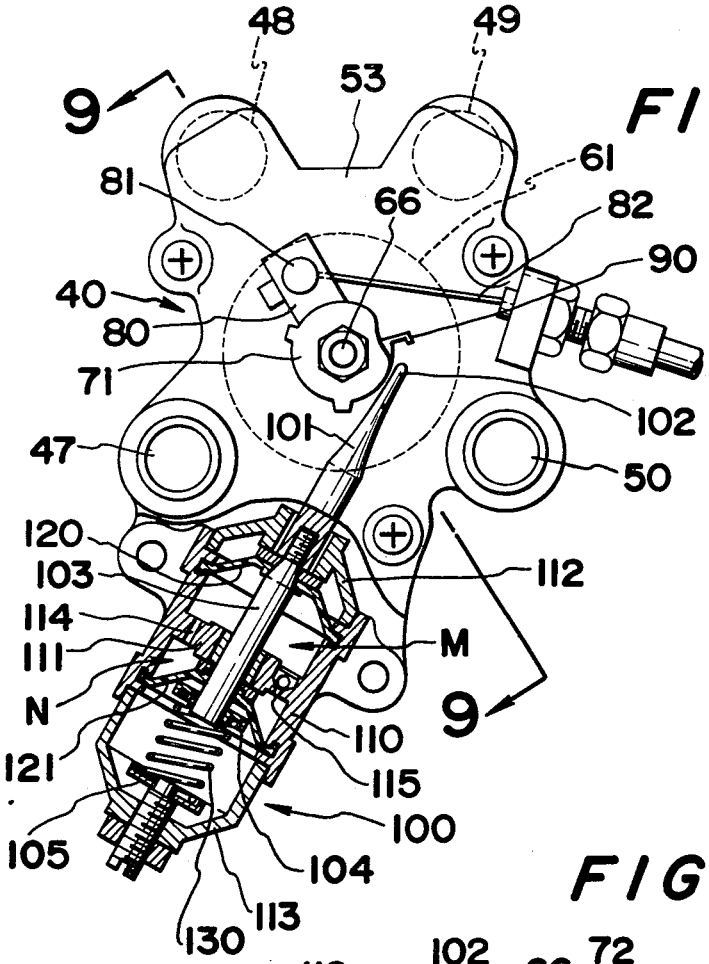
FIG. 8
FIG. 9
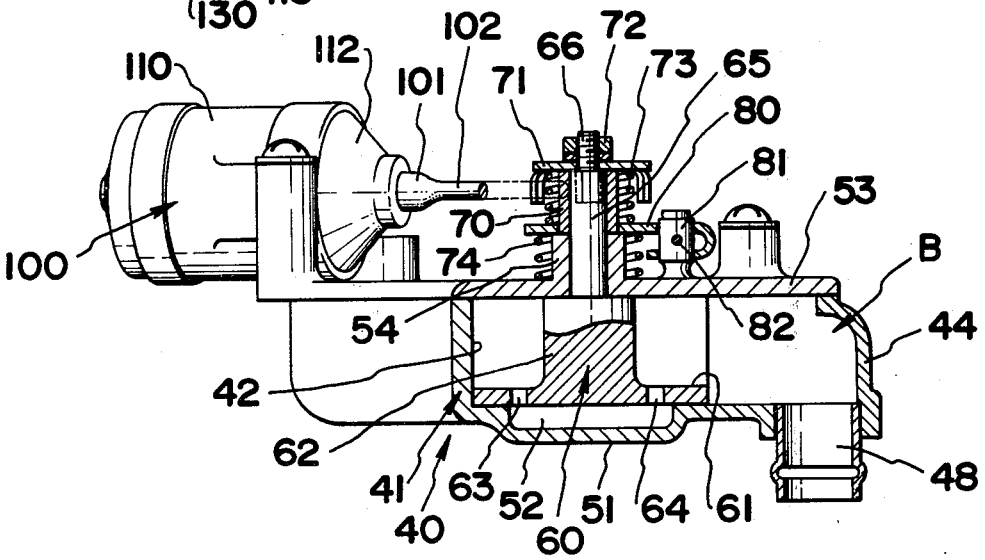

APPARATUS FOR CONTROLLING SECONDARY AIR FOR CLEANING EXHAUST GASES

The present invention relates to an apparatus for cleaning exhaust gases by feeding secondary air to an exhaust path in an engine, wherein the feeding of secondary air is controlled in response to the load condition of the engine.

More particularly, the present invention relates to an apparatus for controlling secondary air for cleaning exhaust gases of an engine, wherein secondary air is fed to an exhaust path in the engine through a control valve operating to be opened and closed as operatively connected with the opening and closing of the throttle valve of a carburetor so that the feeding of secondary air may be optimum in response to the load condition of the engine.

BACKGROUND OF THE INVENTION

Heretofore, there had been suggested an air injection system as an apparatus for cleaning exhaust gases of an automobile, wherein secondary air is injected and fed into an exhaust path near the exhaust valve of an engine, and sufficient oxygen is provided while exhaust gases are in a high temperature state so that detrimental components in the exhaust gases may be oxidized and made nondetrimental.

In this cleaning system, in order to obtain the best cleaning rate, it is necessary to feed a proper amount of secondary air in response to the load on the engine. With an air pump driven generally by the engine to feed such secondary air, the amount of fed air is proportional to the number of revolutions of the engine, but has nothing to do with the load condition (the speed of the automobile) of the engine. Thus, the optimum amount of secondary air cannot be said to be always proportional to the number of revolutions of the engine. Further, at the time of a continuous load (at the time of a high speed running), the secondary air will become excessive, and the exhaust system will be overheated so much as to impair the function and obstruct the cleaning at the time of a low load.

Therefore, there is required a secondary air controlling apparatus wherein a proper amount of secondary air is fed to a system of feeding secondary air to an exhaust path so that the best cleaning may be obtained in response to the engine load, and wherein the secondary air is interrupted to protect the exhaust system at the time of continuous high load (at the time of a continuous high speed operation).

Generally, in an engine for a four-wheeled automobile having multi-cylinders with a single carburetor, the negative pressure in the suction pipe is high and stably varies with the load condition (car speed) as shown by the line H in the graph in FIG. 1. Therefore, a type wherein a control valve for controlling the amount of secondary air fed is operated by such negative pressure in the suction pipe has already been adopted as a secondary air controlling apparatus. The control valve is controlled with such negative pressure in the suction pipe so that secondary air may be fed in response to the load condition of the engine, and may be interrupted with the control valve to protect the exhaust system at the time of a continuous high load operation.

However, in an engine for a motorcycle or autobicycle including a system having a single cylinder with a single carburetor, the suction pipe negative pressure is unstable in the load condition as evident by the line I in the graph in FIG. 1 and, at the time of a high load (at the time of a high speed), the negative pressure will be so low that, in order to make a boost control, the diaphragm for making it will have to be very large. Therefore, the secondary air controlling apparatus would have to be so large as to be difficult to fit in a motorcycle or autobicycle which is restricted as to space, to cause such a serious design problem in case it is to be so fitted, to be high in cost, and to be difficult to adopt.

SUMMARY OF THE INVENTION

The present invention solves the problems in the above-mentioned suction pipe negative pressure system in an apparatus for controlling secondary air for cleaning exhaust gases for engines to be used for motorcycles or autobicycles or the like.

An object of the present invention is to provide a secondary air controlling apparatus wherein secondary air to be fed to an exhaust path in an engine is controlled to be of an optimum amount in response to the engine load condition, without using a suction pipe negative pressure, so that the exhaust may be effectively cleaned.

Another object of the present invention is to provide a secondary air controlling apparatus which is simple in structure while effectively attaining the above-mentioned object, is as compact as possible in its overall form, can be fitted without impairing the appearance and functional beauty to such vehicles having limited space as autobicycles, and is effective in cleaning exhausts of motorcycles or autobicycles or the like.

In particular, according to the present invention, a control valve for controlling secondary air is operated in relation to the opening degree of a throttle valve of a carburetor so as to control the secondary air. The shaft of the throttle valve is provided with a cam so that a lever mechanism may be operated to operate the control valve and control secondary air to an exhaust path. Therefore, even in such engine in which the negative pressure in the suction pipe fluctuates greatly and is low as an engine of a single cylinder with a single carburetor, secondary air for cleaning exhaust gases can be controlled effectively and properly. Therefore, such large diaphragm, as in the case of using a suction pipe negative pressure system for this kind of engine, is not required. Further, as it is entirely formed mechanically, the operation is high in reliability, the contour can be made as compact as possible, and the most desirable apparatus for controlling secondary air for cleaning exhaust gases for motorcycles or autobicycles is obtained.

Further, in the present invention, the adjustment of the opening and closing and the angle of rotation of the control valve for feeding secondary air is operatively connected with the opening degree of the throttle valve. As this control of the control valve with the opening and closing of the throttle valve is carried out with a cam, the profile of the cam can be set so as to set the optimum amount of secondary air in response to the engine condition (car speed). This setting can be easily made by the profile of the cam.

Therefore, an object of the present invention is to inexpensively provide an effective and proper apparatus for controlling secondary air for cleaning exhaust gases of an entirely mechanical type, which is simple and compact in structure.

A further object of the present invention is to provide such apparatus for controlling secondary air for cleaning exhaust gases wherein a decrease in cleaning the exhaust gases is prevented when making quick accelerations for a short time, as in city driving.

In the present invention, the amount of secondary air fed is controlled by controlling the control valve in response to the opening degree of the throttle valve and, at the time of a continuous high load operation (at the time of a continuous high speed operation), the feeding of secondary air to the exhaust path should be interrupted to protect the respective members forming the exhaust system from heat-breaking.

In the present invention, because the controlling operation of the control valve is operatively connected with the opening degree of the throttle valve, in the case of making quick accelerations for a short time as in city driving, the action of protecting the exhaust system by interrupting the secondary air would be made. Therefore, before the number of revolutions of the engine rises sufficiently, the feeding of secondary air would be interrupted and, when the most detrimental exhaust gases are discharged, no secondary air would be fed. This, of course, would be desirable to the cleaning of exhaust gases.

Consequently, as a result of making various investigations to make the present invention more perfect, it has been discovered that, even if the fluctuation of the engine load is great and a high load operation is made quickly as at the time of a quick acceleration, the exhaust system will not reach a quick heat saturated state and that no damage by heat will occur in such exhaust system. Thus, even if the engine comes to a high load condition, exhaust gases will be able to be cleaned by feeding secondary air and heat damage will not occur in the exhaust system.

Therefore, another object of the present invention is to provide a secondary air controlling apparatus wherein secondary air can be effectively fed to the exhaust system without being interrupted when the load fluctuation is quick and great, as at the time of a quick acceleration.

Thereby, the present invention provides also a secondary air feeding apparatus which prevents the exhaust cleaning action from being reduced by the protecting action at the time of a quick acceleration or the like, and effectively carries out an exhaust cleaning action as at the time of a quick acceleration when the most detrimental exhaust gases are generated.

BRIEF DESCRIPTION OF THE DRAWINGS

FIG. 8 is a plan view of the control valve showing in section a means of slowly controlling the control valve at the time of a quick acceleration so that the control valve may not interrupt secondary air for a fixed time.

FIG. 9 is a sectioned view on line 9—9 in FIG. 8 showing the controlling means not in section and only the parts of it necessary for the explanation.

DETAILED DESCRIPTION OF PREFERRED EMBODIMENTS

Figure 1:
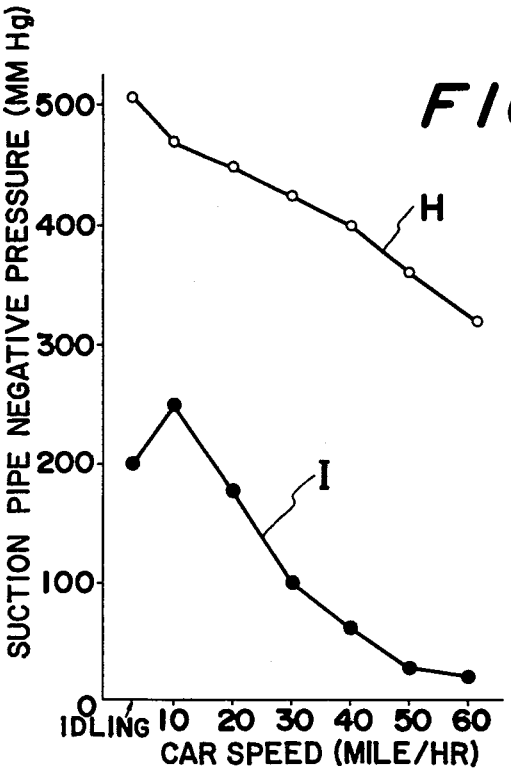
FIG. 1 is a graph showing the relations between a suction pipe negative pressure and car speed explained above.
Figure 2:
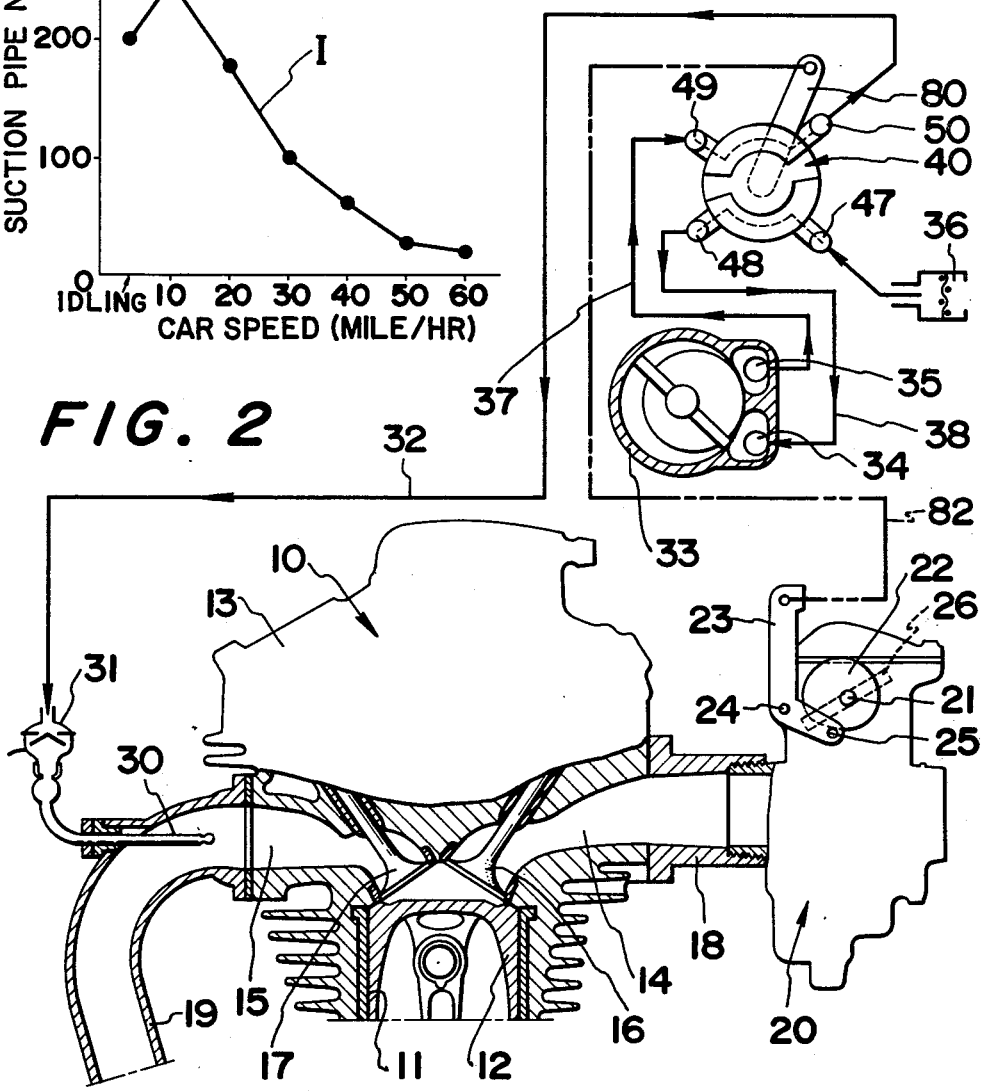
FIG. 2 is a partly sectioned schematic explanatory view of a secondary air feeding apparatus according to the present invention.

As shown in FIG. 2, an engine 10 is provided with a cylinder 11 and piston 12. The top part of the cylinder 11 communicates with a suction path 14 and an exhaust path 15 provided in a cylinder heat 13. A suction valve 16 and an exhaust valve are fitted in said paths, respectively, and are to be opened and closed with rocker arms (not shown).

The suction path 14 communicates with a carburetor 20 through a connecting pipe 18 to lead a gaseous mixture into the cylinder 11. The exhaust path 15 is connected with an exhaust pipe 19 so that exhaust gases burned in the cylinder 11 may be sent to a reburning means through the exhaust pipe 19 to be cleaned, and discharged into the atmosphere.

An air injection nozzle 30 to feed secondary air is provided in a position adjacent to exhaust path 15 of engine 10 within exhaust pipe 19. The nozzle 30 is connected with a secondary air feeding pipe line 32 through a check valve 31 allowing only flow of secondary air into the exhaust path. The secondary air feeding pipe line 32 is connected with the delivery port 35 side of an air pump 33 through a pipe line 37. A suction port 34 of air pump 33 communicates with the atmosphere through an air cleaner 36 via a pipe line 38 so that cleaned secondary air may be sucked in, may be compressed by pump 33, may be sent to nozzle 30 through delivery port 35 and pipe lines 37 and 32, and may be injected and fed into exhaust pipe 19 through nozzle 30.

An air control valve 40 for controlling the amount of secondary air fed is disposed in the secondary air feeding system connecting injection nozzle 30 with air pump 33.

The air control valve 40 is illustrated in FIGS. 4 to 9.

The control valve 40 consists of a valve body 41 in which paths A, B, C and D are formed radially in four directions and a rotor 60 forming a valve.

The body 41 is provided in its center with a wall 42 having a circular inner periphery. The wall 42 has a circular chamber G formed therein, is opened in four places, and has radially outward projections 43, 44, 45 and 46 formed integrally therewith. Through holes 47, 48, 49 and 50 are formed in projections 43, 44, 45 and 46, respectively. The through hole 47 communicates with the atmosphere through air cleaner 36. The through hole 48 connects with suction port 34 of pump 33 through pipe line 38. The through hole 49 is connected with delivery port 35 of pump 33 through pipe line 37. The through hole 50 is connected with injection nozzle 30 through pipe line 32.

The rotor 60 is disk-shaped, fits closely in the lower part within wall 42 of body 41 and is rotatably mounted to be guided on the inner periphery of wall 42. The chamber G sectioned by the wall 42 is formed on the disk-shaped plate member 61 of the rotor 60. A partition wall 62, crossing and partitioning the chamber G, is integrally provided in the center of the rotor 60. Both ends of the partition wall 62 are in close contact with the inner periphery of wall 42 so as to prefectly partition the chamber G, and are formed wide in order to increase the sealability and to effectively partition the path.

Figure 4:
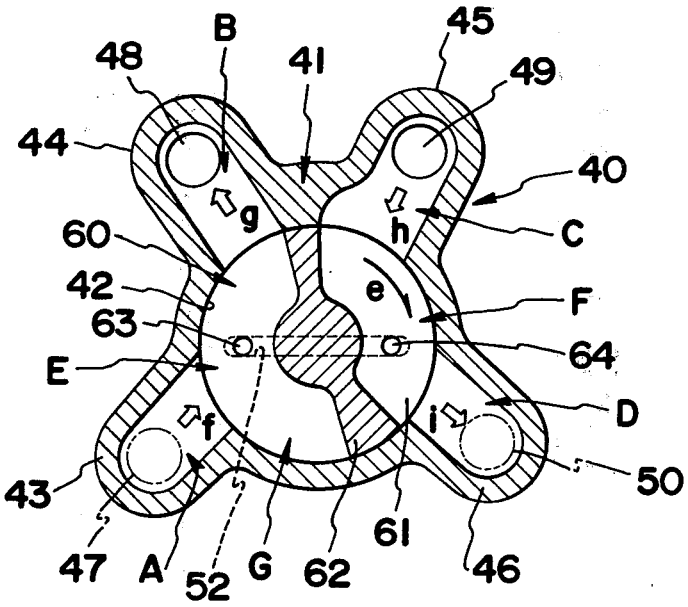
FIG. 4 is a sectioned plan view showing the operation of a control valve, showing only the essential parts to have the operation easily understood and showing the control valve when the engine is idling and in a low load range.

The bottom of the body 40 is closed with a bottom member 51 (FIG. 9) a long linear groove 52 is formed on this bottom member 51, as shown in FIG. 9, and is provided so as to connect the middles of the paths A, B and C, D within the body 40. Leak holes 64 and 63 communicating with both ends of the long groove 52 are formed on the right and left portion of the plate member 61 of the rotor 60 partitioned by the partition wall 62, and are arranged so as to coincide with the long groove 52 at an angle of rotation of the rotor 60 in a non-load or low load (idling or low speed running) state as is shown in FIG. 4.

The top of the body 40 is closed with a lid member 53 as shown in FIG. 9. A cylindrical bearing part 54 extending above is formed in the center of lid member 53. A shaft part 65, projecting on partition wall 62 in the center of rotor 60, is fitted and inserted in the cylindrical bearing part 54 and is extended upwardly at its free end through cylindrical bearing part 54.

A cylindrical spacer 70 is provided on cylindrical bearing part 54, is fitted to shaft part 65 extended above cylindrical bearing part 54, and is provided at its upper end with a pressing plate 71 which is pressed downwardly by screwing a nut 72 to a screw part 66 provided at the upper end of shaft part 65. The outside diameter of spacer 70 is formed to be smaller than the outside diameter of cylindrical bearing part 54 of the lid member 53. The base part of an operating lever 80 is integrally connected to the periphery of the lower end of spacer 70.

A damper spring 73 is provided between the upper surface of the operating lever 80 and the pressing plate 71 so as to connect them. A return spring 74 is provided between the lower surface of the operating lever 80 and the upper surface of the lid member 53.

The operating lever 80 is provided in its end part with a cable holder 81 with which a control cable 82 is connected at one end.

The control cable 82 is connected at the other end with the upper end of an L-shaped link 23 pivoted with a shaft 24 on the side surface of the carburetor 20 as shown in FIG. 2. A pin 25 is provided at the free end of the L-shape of this link 23 so as to be parallel with the shaft 21 driven as operatively connected with the opening and closing of the throttle valve of the carburetor and is slid in contact with the outer peripheral cam surface of the disk-shaped cam 22 connected with the part extended out of the carburetor body of the throttle valve shaft 21.

By the opening and closing operation of the throttle valve (not shown) provided in the carburetor, the shaft 21 is rotated as operatively connected with it, and the cam 22 connected and integral with it is also rotated. The link 23 sliding in contact with the outer peripheral cam surface of the cam 22 is rocked with the shaft 24 as a fulcrum. As a result, control cable 82 is pulled or returned.

With the operation of cable 82, the operating lever 80 rotates with shaft part 65 as a fulcrum and spacer 70 also rotates integrally therewith. This rotation is transmitted to pressing plate 71 through the damper spring 73 and, as the pressing plate 71 is made integral with the shaft part 65 through the nut 72 and screw 66, the shaft part 65 rotates. As a result, the rotor 60 rotates. This rotation is responsive to the rotation of the throttle valve shaft 21 of carburetor 20 and is made in accordance with the profile of cam 22 so as to control secondary air. During this rotation, operating lever 80 will always be resiliently pressed in the return direction by the return spring 74. When the pulling operation force by cable 82 is released, the operating lever 80 will be returned to its original position. The returning force will be transmitted to the link 23 through cable 82, and the cam following action of the link 23 by the contact of the cam 22 with the pin 25 at the time of returning will be made.

Figure 3:
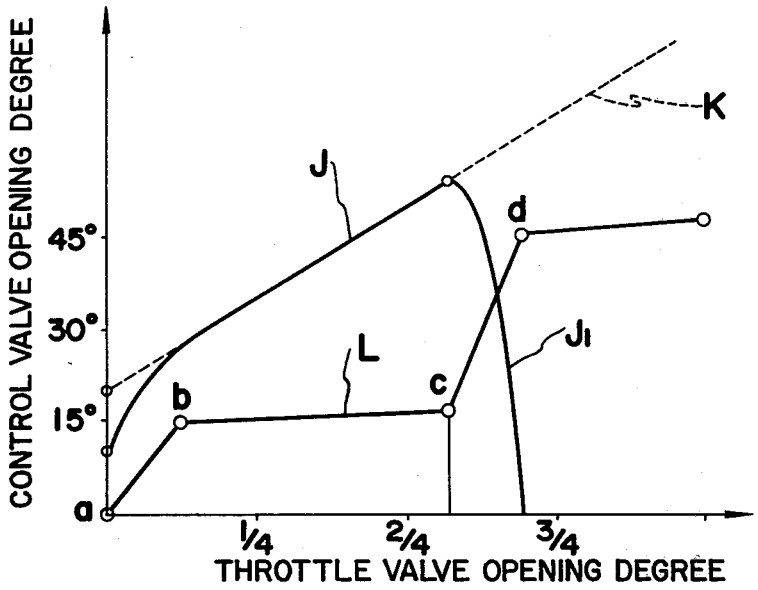
FIG. 3 is a graph showing the relations between a throttle valve opening degree and control valve opening degree in the apparatus according to the present invention.

Now the operation of the control valve will be explained in relation to the graph in FIG. 3. FIGS. 4 to 7 show the processes of the operation of the control valve. FIG. 3 shows the relations between the opening degrees of the control valve 40 and the throttle valve of the carburetor 20. In FIG. 3, the X-axis represents the opening degree of the throttle valve, and the Y-axis represents the opening degree of the control valve.

In the graph in FIG. 3, the line J represents the fed amount of secondary air by the delivery characteristics of the air pump 33. The delivery characteristics of the pump following such throttle valve opening degree as is represented by the broken line at the points *c* to *d* in the graph are dropped by the secondary air interrupting state described hereinbelow and the broken line K represents the delivery characteristics of a conventional pump. The line L represents the control characteristics by the control valve 40 of secondary air fed by the pump.

The delivery characteristics of the air pump 33 are usually made medium in the partial load range so that the output loss of the engine in the load range in the part of the highest using frequency at the time of running may be made as small as possible.

FIG. 4 shows control valve 40 in the low load range (at the time of a low car speed) from the idling state. The rotor 60 rotates the cam 22 with the rotation accompanying the opening degree to the shaft 21 of the throttle valve, and rotates clockwise in the drawing as shown by the arrow *e* as operatively connected with the opening degree of the throttle valve by the pivotal movement guided by the cam surface of the link 23.

Air enters the path A via through hole 47, as shown by arrow *f*, enters one chamber E partitioned by the partition wall 62 of the chamber G, is led into the through hole 48 as shown by the arrow *g* through the path B, is sucked into the air pump 33 through the pipe line 38 and is compressed. The compressed air is led, as shown by arrow *h*, into the path C via through hole 49 through pipe line 37, is led into pipe line 32 through path D and through hole 50, as shown by arrow *i*, from the other partitioned chamber F, and is injected and fed into the exhaust pipe 19 through the injection nozzle 30 through the check valve 31.

At the time of this idling or low load, the air to fuel ratio will be set to be rich for startability and idling stability. Therefore, in this range, the amount of secondary air will be required to be greater than that required for the ordinary running state. In this state, if the amount of secondary air is excessive, the temperature of the exhaust system will not be able to reach the reaction temperature of such detrimental components as CO and HC in the exhaust gases, and therefore such detrimental components as CO and HC will increase. Consequently, in the period from the idling state to the time of the low load, in order to obtain the best reaction or cleaning of CO and HC, it is necessary to decrease the secondary air.

Therefore, from the idling from the point *a* to the point *c* on the line L in FIG. 3 to the time of the low load, in order to decrease the fed amount of secondary air as in this line, as shown in FIG. 4, the right and left chambers F and E are made to communicate with each other by making leak holes 63 and 64 coincide with the long groove 52. Thus, secondary air fed to the path D through chamber F may leak by detouring to the chamber E side. In this manner, secondary air to be fed to nozzle 30 may be decreased and the optimum cleaning of exhaust gases in the load range may be made.

Figure 5:
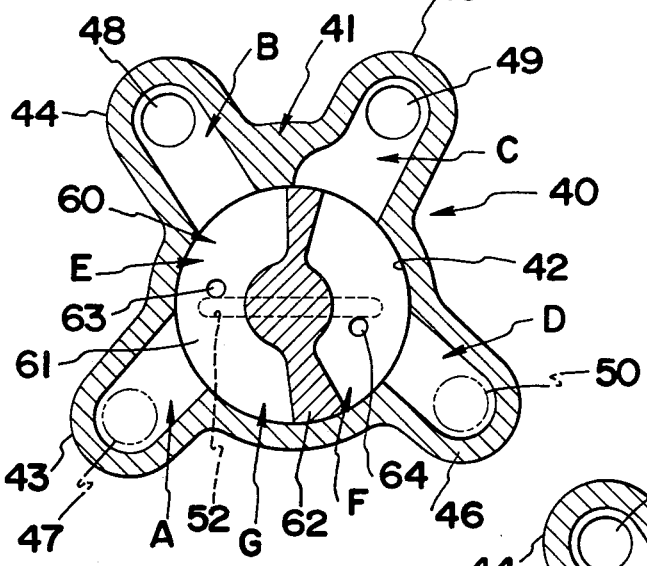
FIG. 5 is the same view as in FIG. 4 and shows an initial state of an ordinary load range of the control valve.
Figure 6:
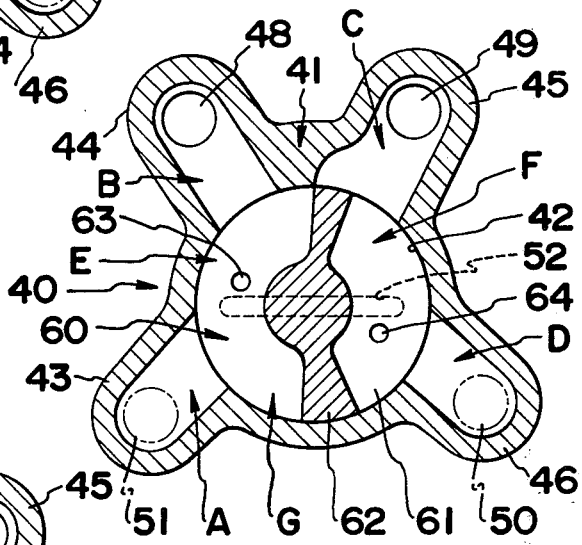
FIG. 6 is the same view as in FIG. 4 showing an end state of the ordinary load range.

FIGS. 5 and 6 show angles of rotation of the control valve in the load range in the ordinary running state when the idling or low load range shifts to the ordinary running state. The point *b* on the line L in FIG. 3 is shown as FIG. 3 and the point *c* is shown as FIG. 6.

As depicted in FIGS. 5 and 6, high pressure secondary air fed to path D through chamber F from path C has the flow sectional area controlled by the end section varying with the variation of the angle of rotation of partition wall 62. Further, the detouring path of the long groove 52 and the leak holes 63 and 64 is interrupted by the rotation of the rotor and the secondary air in the chamber F is controlled by only the end section of the partition wall 62 without leaking to the chamber E side and is sent to injection nozzle 30.

In the ordinary running load range from the point *b* to the point *c* on the line L in the graph of FIG. 3, the fuel from the carburetor responds to the opening degree of the throttle valve and, in this load range, the opening degree of the throttle valve and the sucked gaseous mixture are proportional to each other. Therefore, it is necessary to feed the fed amount of secondary air also in response to the rotation of the engine, that is, the rotation of air pump 33. Meanwhile, secondary air in the amount based on the delivery characteristics of air pump 33 is fed to the exhaust path through path D, pipe line 32 and nozzle 30 to make the optimum cleaning of exhaust gases.

Therefore, as shown by the points *b* to *c* on the line L in the graph of FIG. 3, the angle of rotation of the rotor 60 of the valve is made smaller in comparison with the opening degree of the throttle valve.

Therefore, the capacity of air pump 33 is set to be in the range of this ordinary running load range. In this range, the air-to-fuel ratio is substantially constant, secondary air may be fed in proportion to the amount of sucked air, the amount of the pump delivery increases, and therefore the control is not required.

In a continuous high speed operation load range, the opening degree of the throttle valve increases as shown in FIG. 3. In this load range, the exhaust also increases in temperature and the reaction temperature in the exhaust system also increases. Therefore, the exhaust manifold and reactors will cause heat damage such as cracks and breaks and the catalizer will deteriorate in its performance and will influence the later exhaust treatment.

Figure 7:
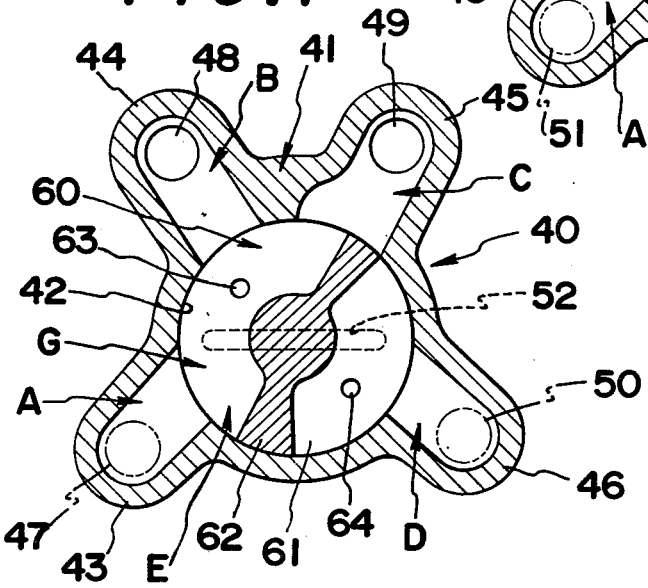
FIG. 7 shows the control valve when secondary air is interrupted at the time of a high load operation.

Between the points *c* and *d* on the line L in the graph of FIG. 3 of the throttle valve, as shown in FIG. 7, the rotor 60 of the control valve is rotated greatly in response to the opening degree of the throttle valve, the partition wall 62 is set in the position in FIG. 7, the paths C and D are interrupted with the partition wall 62 and secondary air fed to the exhaust system through the path D is interrupted. This secondary air is circulated or discharged through the path C, B or A and is not fed into the exhaust. Thus, the exhaust system under the continuous high speed load condition is protected.

The operation of the control valve in this continuous high speed load range quickly interrupts secondary air as shown by the points *c* to *d* on the line L in the graph of FIG. 3. In this case, the delivery characteristics K of the pump in response to the number of revolutions shown by the broken line of the line J in the graph of FIG. 3 reduce as in $J_1$ as shown by the solid line.

Therefore, the profile of the cam surface of the cam 22 connected with the shaft 21 of the throttle valve is set in advance so that the rotation of rotor 60 may become large during the small opening degree of the points *c* to *d* in the graph of the throttle valve and the cam 22 is so set as to rotate and operate the control valve as operatively connected with the opening degree of the throttle valve as explained above.

As well understood in the above, in the apparatus according to the present invention, in the case of feeding secondary air to the exhaust path of the engine, the control valve for feeding secondary air is controlled in response to the opening degree of the throttle valve of the carburetor, the optimum secondary air is fed in response to the load condition of the engine and, under the continuous high speed load condition, the secondary air is interrupted to protect the exhaust system. The control valve is controlled through the link, cable and lever with the cam operated by the shaft of the throttle valve. Such connecting means, such as by a rod or the like, can be used instead of the cable.

FIGS. 8 and 9 show an embodiment in which a delay means 100 is attached to the control valve so that secondary air may be more effectively controlled.

An engaging piece 90 is provided to project outward on the periphery of the pressing plate 71. The engaging piece 90 and the tip 102 of the rod 101 are provided so that the engaging piece 90 may collide with the top 102 of the rod 101 of the delay means 100 at a fixed angle with the basic angle of the rotor 60, that is, at the point *c* in FIG. 3.

As shown in FIG. 8, the delay means 100 may be of the dash pot type.

The rod 101 is connected at its base and with the tip of a shaft 103 slidably fitted in its longitudinal direction in a case 110. The interior of the case 110 is partitioned into front and rear chambers M and N by a partition wall 111 crossing its mid-section. The shaft 103 is slidably fitted and supported in the center of partition wall 111. In the front chamber M, a diaphragm 120 made of rubber or the like is provided and is connected in its center with the tip of shaft 103 and in its periphery with the inside wall of the chamber M. In the rear chamber N, a similar diaphragm 121 is provided and is connected in its center with the base of shaft 103 and in its periphery with the inside wall of chamber N. The front of the diaphragm 120 is closed with a lid member 112 which also ensures the linear motion of rod 101. The rear of diaphragm 121 in rear chamber N is closed with a bottom member 113 which is also a spring case.

In the chambers M and N oil is provided. An orifice 114 making chambers M and N communicate with each other is provided in partition wall 111 and a check valve 115 opening only when the oil returns is provided.

A spring receiver 104 is provided in the base end part extended out of the diaphragm 121 of the shaft 103. A return spring 130 is provided between spring receiver 104 and a spring receiver 105 provided on the inner bottom of bottom member 113 so as to always resiliently press rod 101 including shaft 103 forwardly.

In this delaying means 100, in the base of the ordinary rotation controlling operation of the control valve 40, the rotor 60 rotates slowly according to the above description, the point *c* on the line L in FIG. 3 is reached and the engaging piece 90 contacts the tip 102 of the rod 101. The torque, transmitted to pressing plate 71 from operating lever 80 through damper spring 73, is transmitted as it is to engaging piece 90, pushes the tip 102 of rod 101 and retracts rod 101 and shaft 103. With the resultant deformation of diaphragm 120, the volume in chamber M varies. The oil in chamber M flows into chamber N through orifice 114, and check valve 115 remains closed. Thus, the oil flows into chamber N from chamber M following the rotating velocity of rotor 60.

Therefore, at the time of ordinary slow engine load fluctuation, the delay means 100 effects no delaying operation.

In the case of making a quick acceleration for a short time as in city driving, the load condition of the engine fluctuates greatly and rapidly from the low load range to the high load range. With the quick shift to the high load range of the engine, the opening degree of the throttle valve also follows it, the angle of rotation of the rotor 60 of the control valve 40 rapidly becomes large and, as mentioned above, the path D is closed thereby interrupting the feed of secondary air to the exhaust system. Therefore, in the state that the most detrimental exhaust gases are produced at the time of the quick large load fluctuation, secondary air cannot be fed to the exhaust gases.

Therefore, in the high load range at the time of a quick acceleration, it is necessary to feed secondary air without interrupting it. When the high load range is quickly reached, as at the time of a quick accleration, the exhaust system will not yet have reached the thermally saturated state.

When the low load range quickly shifts to the high load range, as at the time of a quick acceleration, the delaying means 100 will operate as follows.

Under the above-mentioned condition, the lever 80 operating rotor 60 will be pulled by cable 82 to quickly rotate clockwise in FIG. 8 by the quick variation of the throttle valve opening degree. The engaging piece 90 of pressing plate 71 will quickly collide with tip 102 of rod 101 under the action of damper spring 73 and will tend to quickly return the rod 101 and shaft 103. However, in this case, the quick return of the rod 101 will be prevented by the restriction of orifice 114 to the oil from chamber M to chamber N and the oil will not flow more than through the flow sectional area of orifice 114. Therefore, the rod 101 connected with diaphragms 120 and 121 will be delayed in the retreat by the time constant set by orifice 114 and, even if it is attempted to rotate rotor 60 with the twisting torque of damper spring 73, the rotation variation of rotor 60 with the throttle valve opening degree variation will be delayed by the action of the rod 101.

The rotation of rotor 60 will be delayed for the time of the time constant set by the orifice 114. Therefore, even if the rotating position of lever 80, responsive to the throttle valve opening degree, has already operated the angle of rotation of rotor 60 so as to be in the secondary air interrupting range, the paths C and D will be made to communicate with each other to feed secondary air to the exhaust system within the delayed set time. After the lapse of the time required for the flow of oil through orifice 114, the rod 101 and shaft 103 will retreat to the rotation limit of engaging piece 90. Thus, the path D to the exhaust system of control valve 40 will be interrupted, as shown in FIG. 7, and the exhaust system at the time of continuous high load operation will be protected.

The rod 101 is returned by the return spring 130. In such case, the oil will flow from chamber N into chamber M not only through orifice 114 but also through check valve 115 which will open so that rod 101 may quickly return.

At the time of a quick acceleration or the like for a short time, even if the throttle valve reaches a quick high load range, the operation of the control valve for the feeding of secondary air will be delayed, such detrimental components as CO and HC generated in such case will be cleaned without influencing the exhaust system and an effective exhaust treatment will be able to be made.

In the above illustrated embodiment, the delaying device is formed of a dash pot, but may also be operated in the same manner as is mentioned above by such means as a spring.

Thus, according to the present invention, secondary air is mechanically controlled in relation to the opening degree of the throttle valve and not only under the ordinary running condition but also in case the load fluctuation is quick and large, by attaching the delaying means, exhaust gases can be effectively cleaned and an effective exhaust treatment can be made. Further, even though the delaying means is included, the contour is compact, the exhaust treatment can be effectively made in engines of such type of a single cylinder with a single carburetor as in motorcycles or autobicycles, the structure is simple and is entirely mechanically formed and therefore an apparatus for controlling secondary air for cleaning exhaust gases which is high in reliability can be obtained.

We claim:

1. An apparatus for controlling secondary air for cleaning exhaust gases of an engine, comprising:

said engine including a carburetor and a throttle valve;

an air pump operably connected to and driven by said engine;

a secondary air control valve provided with a valve body;

a rotor member (60) rotatably carried in said body and partitioning said body into first and second main chambers;

said control valve including a first path for feeding air to said first chamber;

said control valve including a second path for feeding air to the suction side of said air pump driven by said engine from said first chamber;

said control valve including a third path making said second chamber and the delivery side of said air pump communicate with each other;

said control valve including a fourth path making said second chamber and the exhaust path of said engine communicate with each other; and said control valve including a fifth path making said first and second chambers communicate with each other at a predetermined angle of rotation of said rotor member, said rotor member of said valve being a rotating operating cam formed to be rotated and operated by the operation of said throttle valve of said carburetor of said engine.

2. An apparatus according to claim 1, wherein:

said path making said first and second chambers communicate with each other is connected by the angle of rotation of said control valve by the opening degree of said throttle valve at the time of idling or a low load of said engine so that air fed to the exhaust system from said air pump may leak into said first chamber and the feeding of secondary air to the exhaust system may be decreased.

3. An apparatus according to claim 1, wherein:

a partition wall, fitted to said rotor member, having a substantial end section, and partitioning said body into said first and second chambers, is provided so that the cross-sectional area of the path communicating with the delivery side of said air pump may be substantially varied with the end section of said partition wall by the rotation of said rotor member of said control valve by the opening degree of said throttle valve in the ordinary running load range of said engine to control the amount of secondary air to the exhaust system.

4. An apparatus according to claim 1, wherein:

by the angle of rotation of said control valve by the opening degree of said throttle valve at the time of a continuous high load of said engine, said fourth path is interrupted, and said first, second and third paths are connected to protect the exhaust system.

5. An apparatus according to claim 1, including:

means for rotating said rotor member (60) of said control valve;

an operating member (80) operatively connected to said rotor member (60);

a cam (22) operatively connected to and rotatable with the opening and closing of said throttle valve; and a member (23) rocked by said cam (22) so that said member (23) may be operated in response to rotation of said cam (22), said member (23) being operatively connected to said operating member (80) to move said operating member (80) which in turn rotates said rotor member (60).

6. An apparatus according to claim 5, wherein:

the profile of said cam (22) is formed so that the angle of rotation of said rotor member (60) may be small at the opening degree in the idling or low load range of said throttle valve, may be very small at the opening degree at the start point and end point of the ordinary running load range of said throttle valve, and may increase rapidly and greatly at the opening degree after the end point of the ordinary running load range of said throttle valve.

7. An apparatus according to claim 1, wherein said means for operating said rotor member (60) is provided with a return spring (74) operatively connected with said operating member (80) of said rotor member (60) for returning the rotated rotor member (60), and a damper spring (73) for cushioning and transmitting the operation of said cam (22) to said rotor member (60) through said operating member (80).

8. An apparatus according to claim 1, including:

a delaying means (100) operatively connected with said operating member (80) to delay the quick rotation of said operating member (80) at the time of such operation of quickly opening the throttle valve as in a quick acceleration, and to slowly interrupt the feed of secondary air to the exhaust system with the rotation of said rotor member (60) for a fixed time.

9. An apparatus according to claim 8, wherein:

said operating member (80) is operatively connected with said rotor member (60) through a damper spring (73) and a return spring (74) and with an operating member (101) of said delaying means (100) at the end point of the ordinary running load range of the throttle valve.

10. An apparatus according to claim 8, wherein:

said delaying means (100) engages with said operating member (80), follows the slow rotation of said operating member (80), resists at a rotation above a fixed angle of said operating member (80), and slowly controls the rotation of said operating member (80).

11. An apparatus according to claim 10, wherein said delay means (100) comprises:

slidable means (101) engaging at a fixed angle of the rotor operating member (80) with an engaging member (90) provided at a fixed angle of said rotor operating member (80);

a member (120) operatively connected to said slidable means (101) for varying the volume within said delay means (100) with its sliding and for making said slidable means (101) resist with such volume variation; and a member (130) returning said slidable means (101) at the time of engaging and disengaging of said slidable means (101) with said engaging member (90) of said rotor operating member (60).

* * * * *